US006666270B2

(12) United States Patent
Vann

(10) Patent No.: US 6,666,270 B2
(45) Date of Patent: Dec. 23, 2003

(54) RECIPROCATING PUMP VENT-DUMP VALVE AND METHODS OF USE

(76) Inventor: Roy R. Vann, 9517 Tosha La., Flint, TX (US) 75762

( * ) Notice: Subject to any disclaimer, the term of this patent is extended or adjusted under 35 U.S.C. 154(b) by 0 days.

(21) Appl. No.: 10/374,567

(22) Filed: Feb. 25, 2003

(65) Prior Publication Data

US 2003/0159831 A1 Aug. 28, 2003

Related U.S. Application Data

(60) Provisional application No. 60/360,240, filed on Feb. 26, 2002, and provisional application No. 60/392,991, filed on Jul. 1, 2002.

(51) Int. Cl.[7] ..... E21B 34/00

(52) U.S. Cl. ..... 166/317; 166/332.6; 166/334.3

(58) Field of Search ..... 166/317, 332.6, 166/334.4, 334.3, 105

(56) References Cited

U.S. PATENT DOCUMENTS

| | | | | | |
|---|---|---|---|---|---|
| 2,663,307 | A | * | 12/1953 | Birdwell | 166/334.4 |
| 3,150,605 | A | | 9/1964 | Howe | |
| 3,994,338 | A | | 11/1976 | Hix | 166/105 |
| 4,103,739 | A | | 8/1978 | Hall | 166/105 |
| 4,273,520 | A | | 6/1981 | Sutliff et al. | 417/434 |
| 4,645,007 | A | | 2/1987 | Soderberg | 166/374 |
| 4,909,326 | A | | 3/1990 | Owen | 166/317 |
| 5,018,581 | A | | 5/1991 | Hall | 166/373 |
| 5,782,303 | A | * | 7/1998 | Christian | 166/373 |

* cited by examiner

*Primary Examiner*—David Bagnell
*Assistant Examiner*—Matthew J Smith

(57) ABSTRACT

A reciprocating pump vent-dump and methods of use for utilization in the hydrocarbon industry. The device is preferably used with barrel pumps although it may be used with tubing pumps. The device is positioned at the bottom of the wellbore immediately above the stinger and immediately below above the standing valve and comprises a sliding piston within an outer housing. The device may be opened pulling upwards on the pump drive mechanism thereby allowing fluid within the production tubing to drain back into the formation as long as the pump drive mechanism is held up. The device closes when the pump is returned to normal operation.

15 Claims, 15 Drawing Sheets

RECIPROCATING PUMP VENT-DUMP VALVE AND METHODS OF USE

This application claims priority from Provisional Patent Application No. 60/360,240 filed on Feb. 26, 2002 and Provisional Patent Application No. 60/392,991 filed on Jul. 1, 2002.

The present invention relates generally to the oil and gas industry and in particular to oil well production utilizing reciprocating pumps.

BACKGROUND OF THE INVENTION

Oil wells are produced using a variety of methods ranging from self-production, where the formation pressure is high enough to cause the oil to flow up the wellbore, to various forms of artificial lift, where the formation pressure is insufficient and cannot lift the hydrocarbon fluid up the wellbore. The most common artificial form used in the oil industry is the reciprocating pump.

The standard industry reciprocating pump consists of a prime mover that is positioned at the surface, and a pumping barrel that is positioned within the production tubing at or near the bottom of the wellbore. The wellbore is lined with steel pipe called casing.

The production tubing is concentric within the casing and is the conduit through which produced fluids are sent to the surface. The area between the production tubing and the casing (wellbore) is called the annulus. The production tubing is generally suspended from the surface and "rests" against the casing forming a seal at the surface. The steel casing has a series of holes or perforations punched in the casing where the producing formation is found, that allow the formation fluid to enter the annulus.

The production tubing has a "seating nipple" at the formation end of the tubing into which the pump will seat. The tubing may be terminated in a rounded end with a series of perforations that act as a course filter and allow the formation fluid to enter the production tubing. The seating nipple has a reduced inside diameter when compared to the tubing that forms a hold-down into which the pump barrel locks or is held-down. The barrel is locked into place within the production tubing so that a seal is formed between the pump and the production tubing. This seal keeps the produced fluid from re-entering the formation.

There are two ways by which the pump at the end of the production tubing is driven (reciprocated). The first uses the industry standard sucker rods, and the second uses a new technique that employs a wire cable. Both the cable and the sucker rod string terminate at the pump and at the prime mover. A cable driven pump will employ the same (or similar) pull rod at the downhole end plus a set of sinker (weighted) rods.

After a period of time, the downhole pump must be serviced, and the cable or sucker rod string is employed to lift the pump up and out of the well. The pump is pulled up to the surface within the production tubing. A certain amount of force is required to "pop" the pump loose from the hold-down at the bottom of the production tubing.

Very often the force to "pop" the pump loose is excessive and is caused by build-up of "flower sand" around and about the pump at the hold-down. Flower sand is entrained in the produced fluid and tends to precipitate from the fluid as it passes up the production tubing. The sand then falls to the bottom of the tubing and "packs" around the hold-down thereby substantially increasing the force required to "pop" the pump loose from the hold-down.

Furthermore because there are series of ball and check valves within the pump (the associated standing valve), the initial force required to "pop" the pump loose must also pull against the hydrostatic head contained within the production tubing which thereby increases the required unseating force. As the depth of the well increases, the weight of the produced fluid increases: essentially, the weight of produced fluid is related to the hydrostatic head contained within the production tubing. As soon as the pump pops loose the hydrostatic head will reduce because the fluid in the production tubing will U-tube within the annulus and tubing.

There have been instances when the sucker rod string breaks in two, due to the high force required to "pop" the pump loose, thus leaving the pump in the tubing. At this point, the well operator must pull the production tubing to retrieve the pump: an expensive operation. In the case of the wire cable driven pump, the wire cable is often limited in pulling force, and the tubing would have to be pulled.

Among some of the prior art attempting to solve the problem caused by sand buildup and hydrostatic head are: Hall (U.S. Pat. Nos. 5,018,581 and 4,103,739), Hix (U.S. Pat. No. 3,994,338), Howe (U.S. Pat. No. 3,150,605), Owen (U.S. Pat. No. 4,909,326), Soderberg (U.S. Pat. No. 4,645,007) and Sutliff et al. (U.S. Pat. No. 4,273,520. Hall envisions an auxiliary valve-like device that is placed at some point (mid) in the pump barrel as the barrel is being made up. This valve opens during withdrawal of the pump if the pulling force exceeds a predetermined force caused by sand buildup. If the device does not open, then it is assumed there is no sand buildup and the device may be re-inserted into the wellbore.

Hix describes a frangible rupture disk that is placed between the standing valve and the hold down in a barrel pump assembly. The rupture disk is activated by increasing the pressure in the standing column of produced fluid; thus, some sort of pumping device is required at the surface. The device also incorporates a left hand thread that allows the pump to be unscrewed if the rupture disk fails to rupture. This is a one shot device.

Howe illustrates a complex ball and seat device that is placed at the pump head and drains the tubing fluid above and around the pump whenever the pump is raised out of the tubing. It does not release the hydrostatic head in the tubing.

Owen portrays a tubing unloader that is placed in the tubing itself. As the tubing is pulled upward the unloader opens and allows the entrapped fluid to drain back into the annulus.

Soderberg also describes a tubing unloader that is placed in the tubing like the device of Owens. However, the Sonderberg device uses an increase in fluid pressure to open the device. Again this implies some sort of pump source at the surface. Finally, Sutliff et al. disclose a deep well pump that incorporates a drain valve that allows the pump to drain within the tubing so that the pump is basically pulled dry from the well.

The industry has attempted to solve the flower sand problem by using a bottom discharge valve mounted below the pump and above the lower check valve (stationary valve), that allows back flow of produced fluid within the production tubing, thereby causing a swirl that hopefully picks up the sand about the hold-down reducing the force required to "pop" the pump loose. The valve which is really a second check valve that, on the downstroke, allows flow of produced fluid from the pump barrel into the tubing (Note the valve is spring loaded so that downward force is required to force the produced fluid backwards into the tubing.) The by-passed flow causes a swirl around the bottom section of the pump and up into the tubing. The device helps but, because it is located away from the hold-down and because the backflow fluid still remains within the tubing, it is somewhat inefficient when washing sand. The force required to push the fluid through the bottom discharge valve is supplied by the weight of the sucker rod string (coupled through the pull rod). The required force ("weight") is unavailable in a cable driven pump. ("One cannot push on a rope.") The industry has not resolved the hydrostatic head problem.

Furthermore, the industry must inject corrosion control chemicals into and about the pump. The dead flow area between the pump barrel and the production tubing presents a problem because there is no known method (or apparatus) to place (spot) chemicals in this area. Current methods dump chemicals down the annulus or down the production tubing where the chemical can migrate throughout the system where fluid flow is occurring. Since there is no flow between the barrel and the production tubing, corrosion control chemicals cannot currently be spotted in that area.

Thus, there remains a need for a device that will wash the flower sand buildup from about the hold-down within the production tubing and/or reduce hydrostatic head, thereby reducing the force required to "pop" a pump loose for servicing. The need is even higher for cable driven pumps. There also remains a need for equipment and a method for spotting chemicals in a well.

SUMMARY OF THE INVENTION

The first embodiment (prototype) device is about 12 to 18 inches long, consists of three parts and is run between the ball and seat and the hold down stinger prior to being placed in the wellbore. The embodiment is preferably used with barrel pumps. The first part is the outer barrel that attaches to a standard hold-down stinger. The second part is a hollow moving piston within the barrel. The third part is header that attaches to the piston and connects to the standing valve. In the barrel pump method the device is attached to the barrel (via the standing valve) and lowered into the well; whereas, in the tubing pump method the complete assembly is dropped into the well. Produced fluid normally flows from the hold-down stinger, through the hollow piston, through the header, through the ball and seat assembly of the standing valve and into the pump.

The first embodiment prototype piston has two sets of apertures or ports, a vent aperture set and a dump aperture set, and a series of seal O-rings. The O-rings and apertures remain within the barrel until activated by forces applied from the surface. The header also serves as a valve (referred to as the "head valve") and has a wedge like shape (opposite the end of the header that attaches the standing valve) that will mate with the top (end opposite the hold-down stinger) of the barrel forming a seal. The two sets of apertures, if exposed from within the barrel, will allow fluid to flow from the production tubing into the annulus.

The first embodiment prototype device has four "positions." The entry position, the closed position, the vent position and the dump position. The entry position is the initial position and is kept in this position by an entry shear-pin(s). In the entry position, the head valve is approximately ½-inch away from the barrel, thus, keeping the head valve open; however, the "vent" aperture and the "dump" aperture remain "locked" within the barrel and sealed by O-rings. No fluid can pass from within the hollow piston and the outside of the barrel. Produced fluid only flows from the formation into the pump and onto the surface. (It may not be necessary to employ the entry position when utilizing the instant device in a tubing pump and the entry shear pins may be left out.)

Allow some time to pass and sand to build up around the hold-down stinger. The operator allows the reciprocating system to drive the device downwards toward the bottom of the well. This action shears the "entry" shear pin(s) and allows the head valve to come into contact with the barrel; thereby, placing the device in the closed position. The operator then draws up on the reciprocating system causing the piston to move upwards within the barrel to the "vent" position. This position allows fluid within the tubing to back flow into the annulus through the stinger at the bottom of the tubing. A large portion of the flower sand drops out in the rat-hole. (The rat-hole is that portion of the wellbore that deliberately left below the perforations for the purpose of receiving wellbore debris.) After a reasonable period of time, the reciprocating system is returned to normal. This allows the vent aperture to slide back into the piston thereby terminating reverse fluid flow and returning to the closed position. A series of O-rings would normally assure that no fluid can continue to reverse flow; however, if the O-rings become damaged, the head valve will cutoff reverse flow. This process is repeated as needed.

Now allow that the pump needs to be removed for service. The operator draws up on the reciprocating system causing the piston to move upwards within the barrel to the "vent" position. Additional force is required to shear the "safety-pin" within the barrel. The safety pin prevents the larger "dump" aperture(s) from allowing reverse flow. Additional upward force is then applied that shears the "safety-pin". This then allows the piston to move further upward exposing the larger "dump port(s) or aperture(s)" which allows increased reverse flow. The increase in reverse flow will further wash sand and allow the hydrostatic head to dissipate into the annulus thereby reducing the total pull required to "pop" the pump loose and withdraw it from the well.

The second embodiment prototype piston was developed after a series of field experiments determined that two sets of apertures were not always necessary and the concept of the device could be handled by one set of apertures. (In fact, a set of apertures may range from one to a plurality depending on the total hydrostatic head.) This embodiment is also preferably used with the barrel pump and is slightly shorter than the prototype. The second embodiment piston has a single set of apertures, called vent-dump ports or aperture(s) or venting ports or aperture(s), and a series of seal O-rings. The term venting aperture(s) is used to differentiate between the two embodiments. The O-rings and aperture(s) remain within the barrel until activated by forces applied from the surface. The vent-dump or venting aperture(s), if exposed from within the barrel, will allow fluid to flow from the production tubing into the annulus.

The second embodiment device has three positions because the vent position in the prototype embodiment was found to be unnecessary. These positions are the entry position, the closed position and the vent-dump or venting position. (The term venting is used to differentiate between the two embodiments). As with the first embodiment, the entry position is the initial position and is kept in this position by an entry shear pin or a set of entry shear pins. In the entry position, the header is approximately ½-inch above the barrel and the upper valve or head valve is held open. At the same time the "vent-dump" or "venting" aperture(s) remain(s) "locked" within the barrel and sealed by O-rings. No fluid can pass from within the hollow piston and the outside of the barrel. Produced fluid only flows from the formation into the pump and onto the surface.

Allow some time to pass and require that the system be serviced. The operator allows the reciprocating system to drive the device downwards toward the bottom of the well. This action shears the "entry" shear pin(s) and allows the header to come into contact with the barrel; thereby further closing the device. The device is now "cocked" (capable of being opened) but is in the closed position. That is the upper sloped valve or head valve (the area between the header and the barrel) is closed and initially the venting aperture(s) are sealed (by O-rings) within the barrel.

The operator then draws up on the reciprocating system causing the piston to move upwards within the barrel towards the top of the device. Additional upward force is required to shear the "safety-pin" within the barrel. This then allows the piston to move further upward exposing the "venting aperture(s)" that allow(s) for reverse flow. The reverse flow may be shut off by releasing the upward force thereby placing the venting aperture(s) back in the barrel and assuring a seal-off through the upper sloped valve or head valve. (The head valve is required because O-rings are known to fail and the venting aperture(s) could easily leak fluid.)

It is important to understand why the "safety-pin" is employed in all embodiments. It is possible, during the initial operation of a reciprocating pump for the pump to lift upward due to internal friction in the pump: this action would open the device and allow back flow. In the second embodiment the only set of apertures are much larger than the vent apertures of the first embodiment. If the venting apertures are exposed, produced fluid will constantly run backwards (through the device) and the pump will not be able to lift fluid to the surface. (A similar argument may be made for the dump apertures of first embodiment except that those apertures are ONLY opened when it is time to withdraw the pump.) Therefore, in order to assure that the production tubing will fill with fluid, a safety is employed. In the second embodiment, it must be noted that during "venting operations" the operator must assure that makeup liquid is available to reverse flow down the production tubing. In a similar manner the entry pins (particularly useful when the device is used with barrel pumps) assure that the device will remain closed (sealed) while entering the well. These points will be explained in further detail.

The reverse flow will allow the hydrostatic head to U-tube within the annulus. The amount of reverse flow will be controlled by the length of time that the vent-dump apertures are held open. (Remember that makeup liquid must be provided.) Thus the reverse flow can wash flower sand from around the hold-down; thereby, reducing the total pull required to "pop" the pump loose and withdraw it from the well. The reverse flow can fully "dump" the hydrostatic head and wash flower sand, if no makeup liquid is provided. The reverse flow can wash flower sand if makeup liquid is provided. Finally the reverse flow can position chemicals immediately above the hold-down when a combination of chemicals and makeup liquid is provided.

As will be described in the detailed description of the invention, the device (first two embodiments) may be employed to "spot" well treatment chemicals in the "dead-space" (no general fluid movement) that exists between the seating nipple and the top of the pump barrel. It is known that corrosion occurs in this space and that chemicals cannot readily be spotted in the dead-space. The method of spotting treatment chemicals is a variant of the venting (flower sand) procedure.

DETAILED DESCRIPTION OF THE EMBODIMENT

The device disclosed may be used in conjunction with tubing pump method, stationary pump barrel method, traveling barrel pump method, and other pumping methods that require a standing valve. The oil industry generally defines a standing valve as a valve that causes produced fluid to "stand" in the production tubing. When used in pumping operations, the standing valve in is a check valve (usually one or more ball and seat valves) that allows for the one-way passage of produced fluid from the formation to the surface.

The tubing pump method is probably the most common method of pumping. In the past, when using the tubing pump method, and prior to beginning pumping operations, a standing valve is dropped from the surface to seat into a standard seating nipple located at the bottom of the production tubing. This standing valve provides a means to apply pressure down the tubing to check its integrity and to check the seal the ball and seat, prior to inserting the tubing pump and beginning pumping operations.

Figure 9:
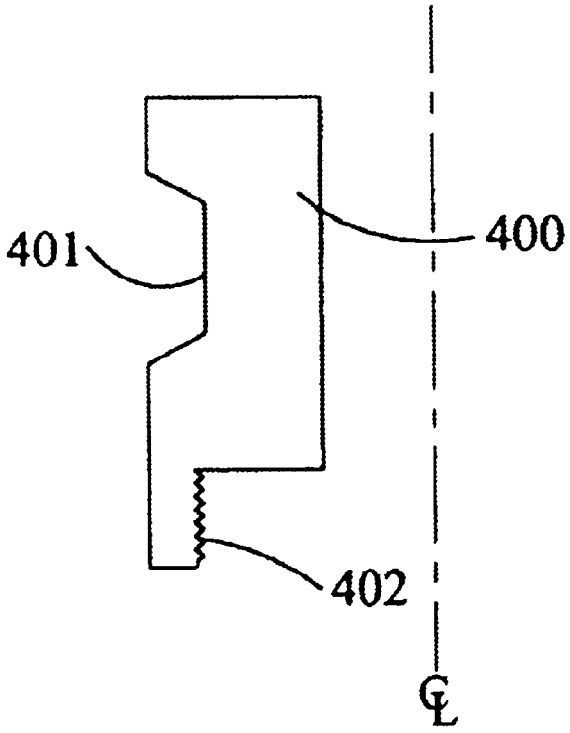
FIG. 9 is a cross-sectional view of the "retriever" attachment used in tubing pump applications.
Figure 10:
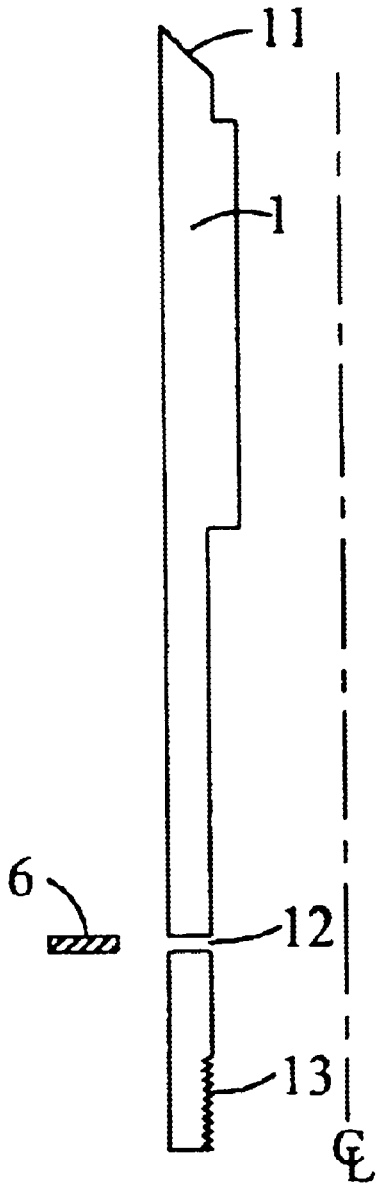
FIG. 10 is a cross-sectional view of the barrel of the prototype embodiment of the instant device showing the "entry-pin".

A minor change in standard procedure is employed when using the instant device with a tubing pump. The instant device is first attached to a standard stinger and standing valve, and the assembly is dropped down the tubing so that the device comes to rest in the seating nipple with the standing valve located on top. The complete assembly now provides a means to apply pressure down the tubing to check its integrity and to check the seal the ball and seat, prior to inserting the tubing pump and beginning pumping operations. (It may not be necessary to run the safety or entry shear pins in the instant device, as will be explained.) Optionally a fish neck (FIG. 9) may be attached to the standing valve.

Typically in the tubing pump method, the standing valve assembly is not retrieved unless the tubing needs to be pulled. If the tubing needs to be pulled, the recommended procedure, which is commonly practiced today when rods are run, is to lower the sucker rod string assembly and thread onto (by rotation) the standing valve and pull up until assembly is released from seating nipple. This sometimes requires a large amount of tension due to hydrostatic and friction forces. As will be explained, the present invention allows the dumping of fluid prior to releasing the hold down from the seating nipple, which will make retrieval easier.

As can be readily expected, the sucker rods allow for sufficient force to be transmitted down the tubing to the standing valve allowing the standing valve to be pulled upwards against the hydrostatic head, friction forces and seating force thereby removing the valve from the tubing. The removal of the standing valve allows the production tubing to drain as the tubing is later pulled. When a cable pump is used with the tubing pump method the cable cannot transmit sufficient force to the standing valve to overcome the hydrostatic head, friction forces and seating force. Therefore, the assembly, described above, of the instant device and a standard standing valve must be employed. When the assembly is used, the cable and special retrieval tool (see FIG. 9) is used to open the vent-dump valve, thereby dumping the fluid in the production tubing and then pulling the entire assembly from seating nipple.

The instant device can also be applied to other pumping methods such as the "traveling" barrel pump system and the "stationary" barrel pump system using similar installation methods. The former system reciprocates to recover fluid on the downstroke whereas the latter system reciprocates to recover fluid on the upstroke. In the barrel pump application the device is attached to the bottom of the standing valve that is attached to the pump. The pump barrel, the instant device, the standing valve and the pump are then "run" (a term of art meaning place into a well) on same trip in a well. When the instant device is run and operated as intended, the pulling of a "wet string" should be eliminated and ease of removal from seating nipple should be enhanced.

Figure 1:
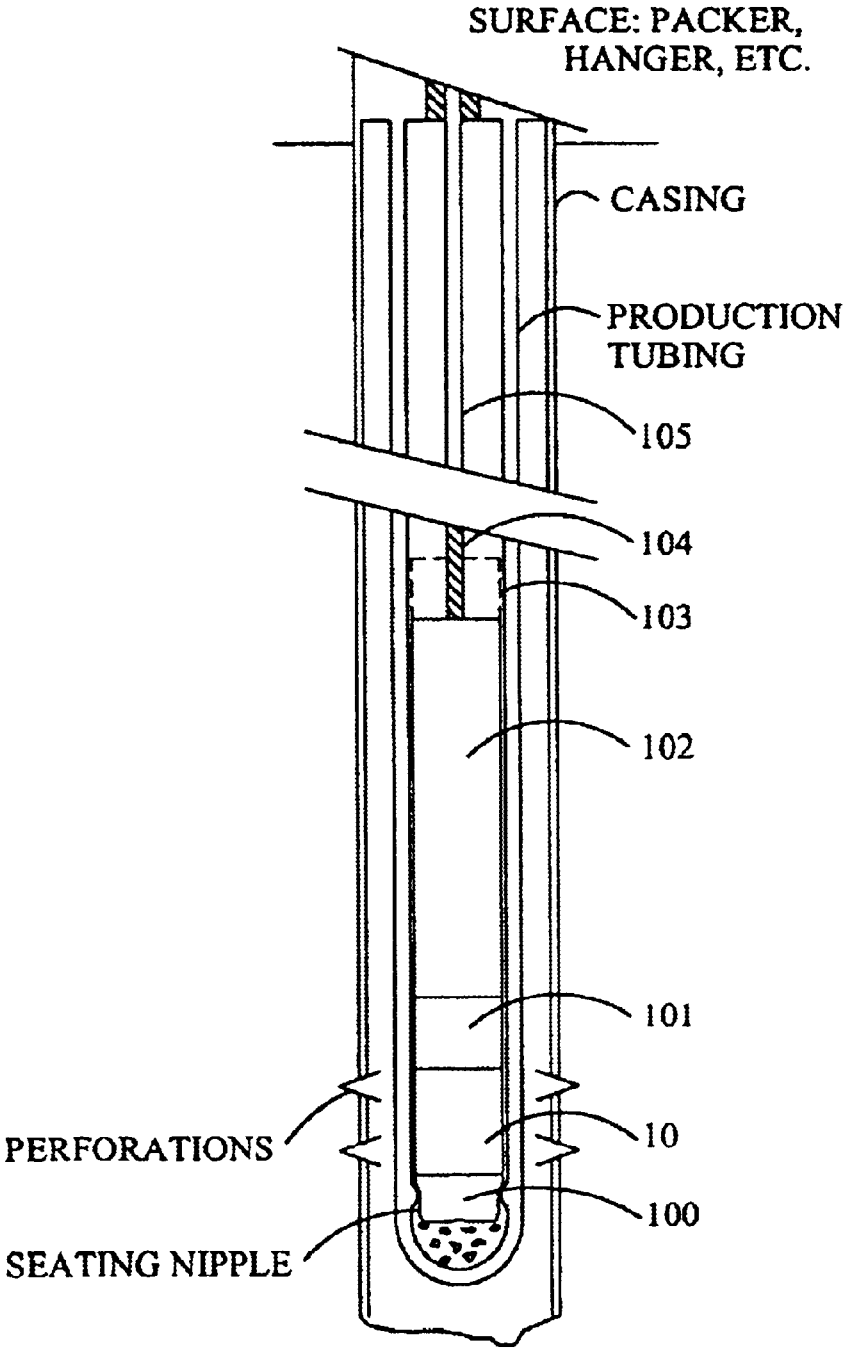
FIG. 1 is a simplified illustration of a wellbore showing the production tubing, a series of sucker rods terminating in a pull rod that is connected to a pump plunger that in turn operates within a pump barrel, and the instant invention connected at the bottom of the pump barrel below the standing valve but above the stinger or cage.

Referring to FIG. 1, the instant invention, vent-dump valve, which is cylindrical in overall shape is shown in place on a standard art reciprocating pump, 102, as currently used in the industry (with a stationary barrel). The description of the embodiments of the instant device will use a stationary barrel pump; however, the instant device will operate with a reciprocating barrel or tubing pump as explained above. Shown in the drawing are the usual standard pull rod, 104, and sucker rod string, 105. The instant device, 10, is located immediately below the standing (ball and seat) valve assembly of the pump, 101, and screws into the standing (ball and seat) valve assembly. The valve cage or stinger, 100, that also interlocks with the seating nipple on the production tubing, screws into the bottom of the instant device. Also shown is the optional upper standing head valve, 103, that is the subject of U.S. Pat. No. 6,382,244 to the present inventor. The upper standing head valve is designed to keep the wellbore (fluid within the production tubing) hydrostatic head away from the formation.

Figure 2:
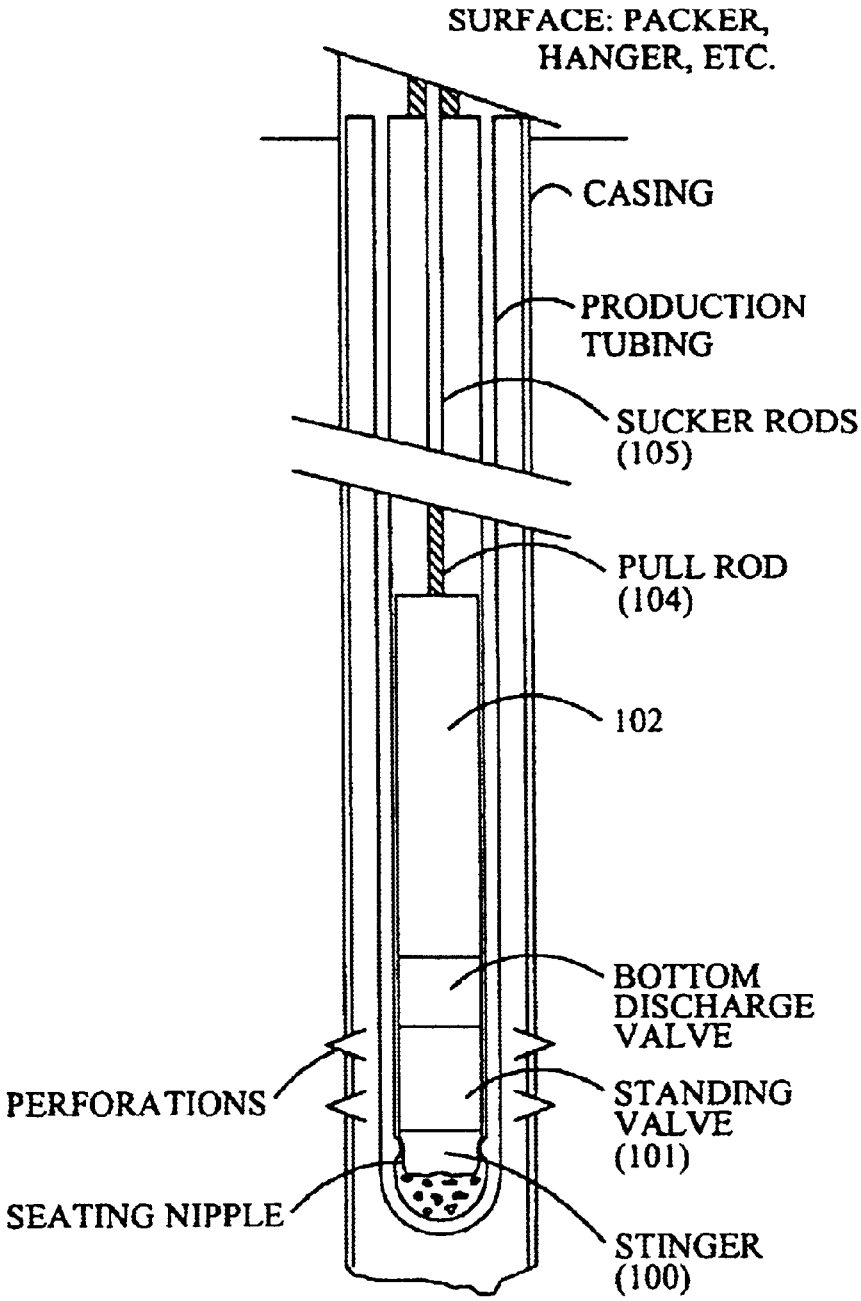
PRIOR ART FIGURE 2
FIG. 2 is a simplified illustration of a wellbore showing the prior art and the production tubing, a series of sucker rods terminating in a pull rod that is connected to a pump plunger that in turn operates within a pump barrel with the prior art bottom discharge valve connected to the bottom of the pump barrel above both the standing valve and stinger.

FIG. 2 shows the prior art utilizing a "Bottom Discharge Valve" that is placed immediately above the standing valve (ball and seat) associated with a barrel pump. The Bottom Discharge Valve is a spring loaded ball and check valve that passes produced fluid into the tubing on the downstroke of the pump. This fluid is intended to stir the fluid within the tubing above the stinger. It should be noted that the "dead" fluid in that area of the tubing remains in place and the entrained/entrapped flower sand is not dissipated back into the rat-hole as with the instant device.

The preferred embodiment of the instant device consists of three basic parts, the barrel, 1; the head, 20; and the piston, 3; plus several ancillary parts. The ancillary parts are the safety ring, 4; the safety shear pin, 5; the entry shear pin, 6; and a plurality of O-rings, 7, which are placed in associated O-ring grooves located on the piston. Two other critical functions (or devices) are formed in the device. These devices or functions are the vent-dump, or venting aperture(s), 9, which is (are) formed in the piston, and the head valve, S, which exists between the head valve face, 21, and the barrel valve face, 11, when the two parts touch during certain operations of the device, as will be described.

Figure 3:
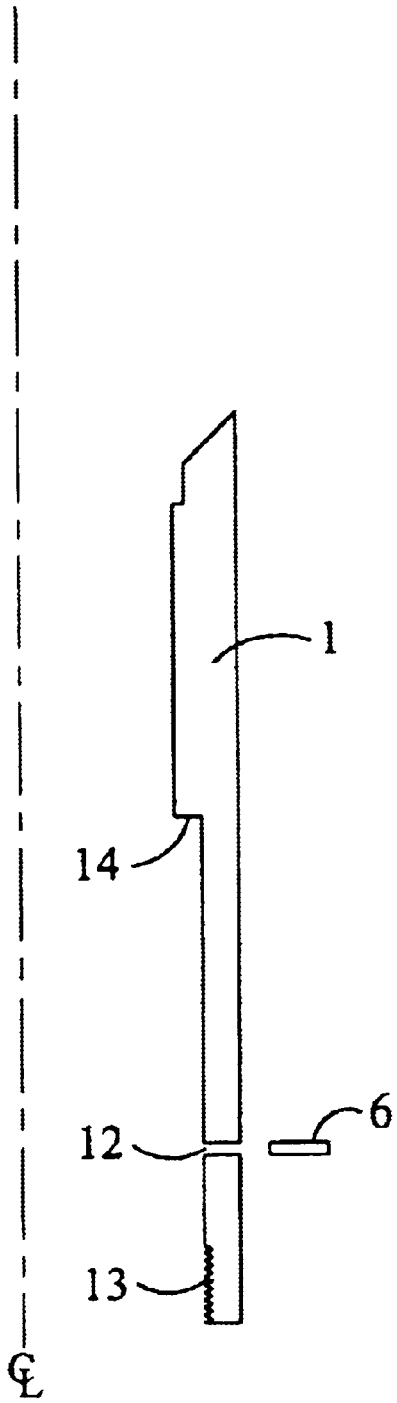
FIG. 3 is a cross-sectional view of the barrel of the instant device showing the "entry-pin".

The piston, 3 (shown in FIG. 4), fits (or slides) within a barrel, 1 (shown in FIG. 3). The barrel has a sloped face, 11, which forms the other part of the head valve, S (see FIGS. 5 and 6). Located near the bottom of the barrel is the Barrel Entry Pin aperture, 12, which accepts the Entry Shear Pin, 6. Located at the bottom of the barrel are threads, 13, which accept a standard valve cage or stinger, 100 (see FIG. 1).

Figure 4:
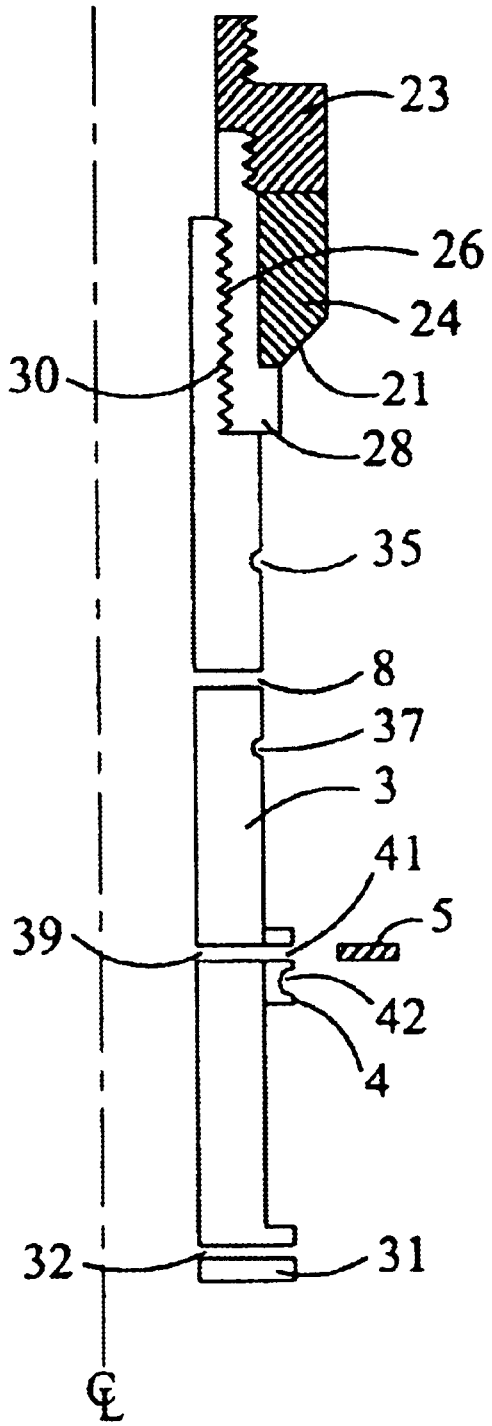
FIG. 4 is a cross-sectional view of the piston and header of the instant device.
Figure 5:
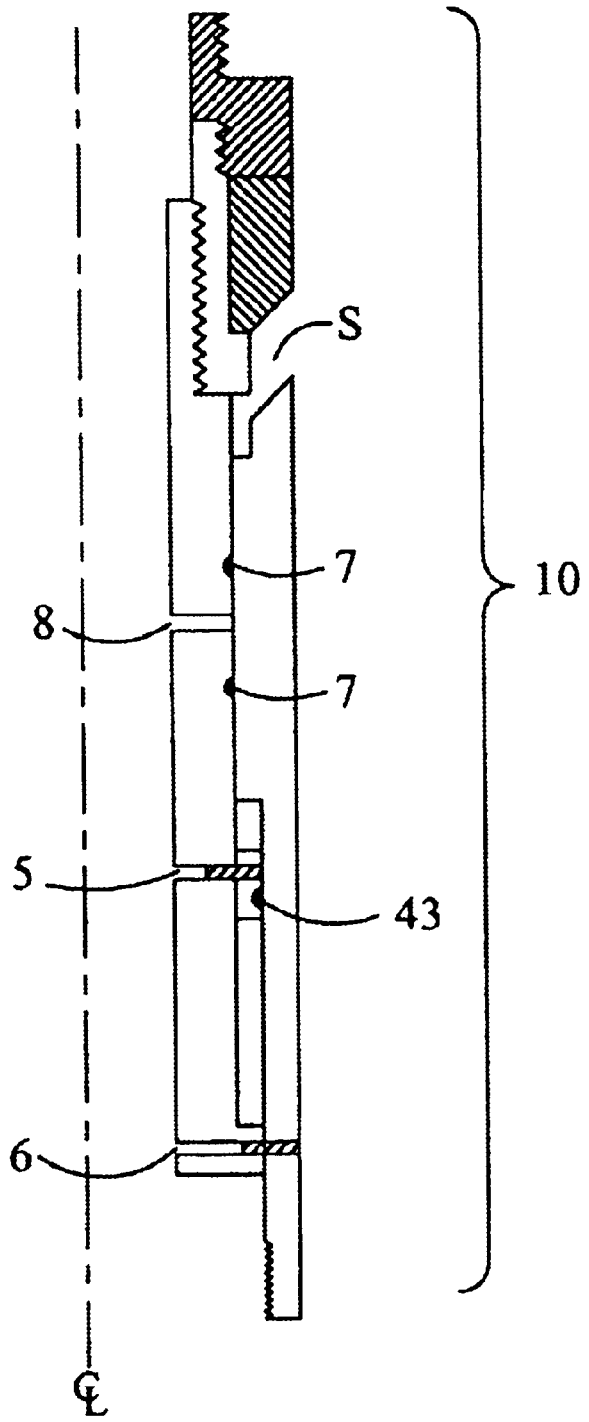
FIG. 5 is a cross-sectional view of the instant device in its "entry" position.
Figure 6:
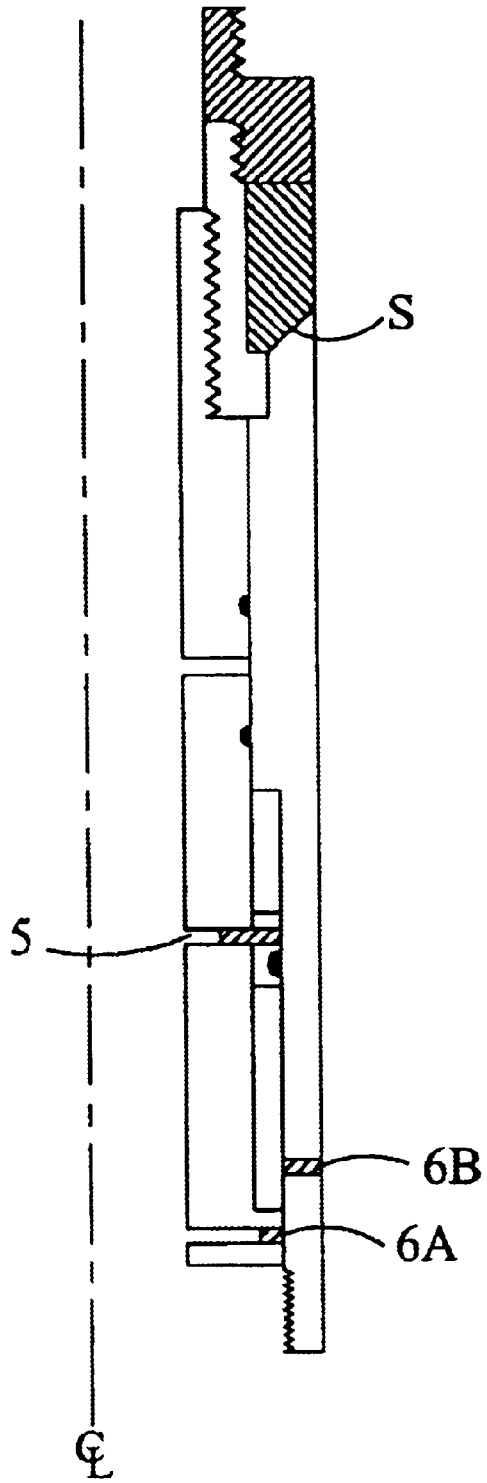
FIG. 6 is a cross-sectional view of the instant device after being taken out of the entry position and showing the head valve in the closed position.
Figure 7:
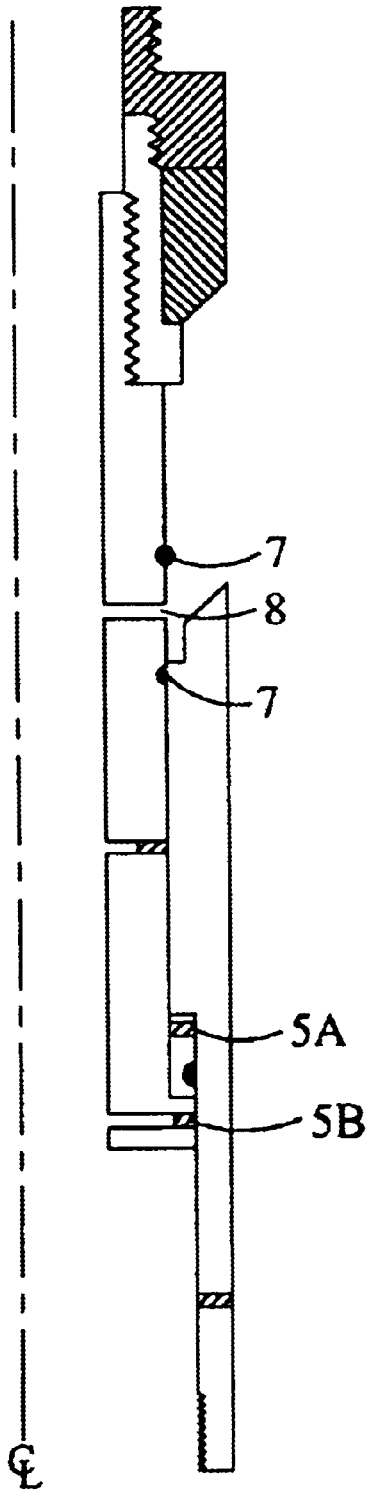
FIG. 7 is a cross-sectional view of the instant device in its "vent" position.

Referring to FIG. 4, the preferred head, 20, is shown screwed into the piston, 3, the reason that these two parts screw together will become apparent later. The head has a sloped face, 21, which forms a part of the auxiliary valve, S (see FIGS. 5 and 6). Located on the piston are a series of O-ring grooves, 35 and 37. These grooves accept O-rings, 7, as shown in FIGS. 5 through 7.

Figure 8A:
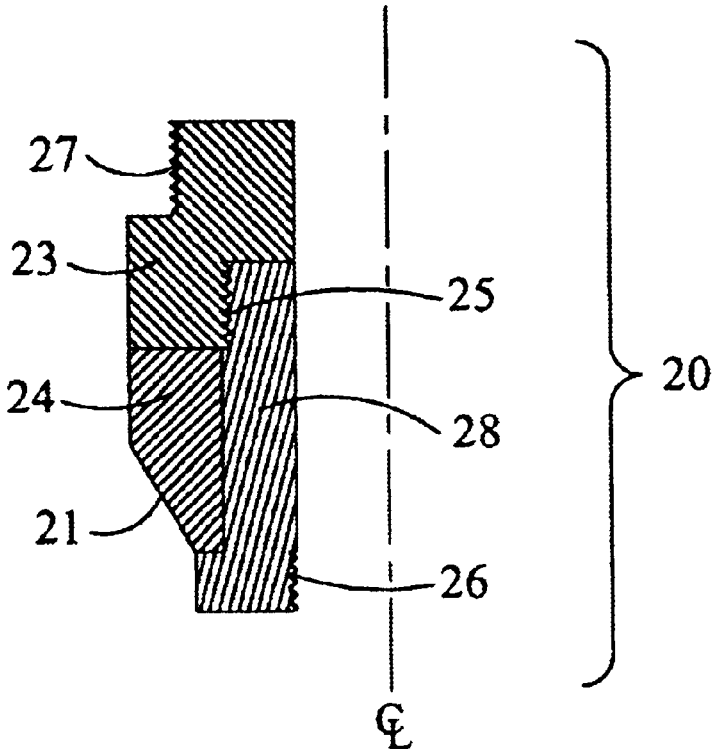
FIG. 8A is an enlarged cross-sectional view of the preferred head.
Figure 8B:
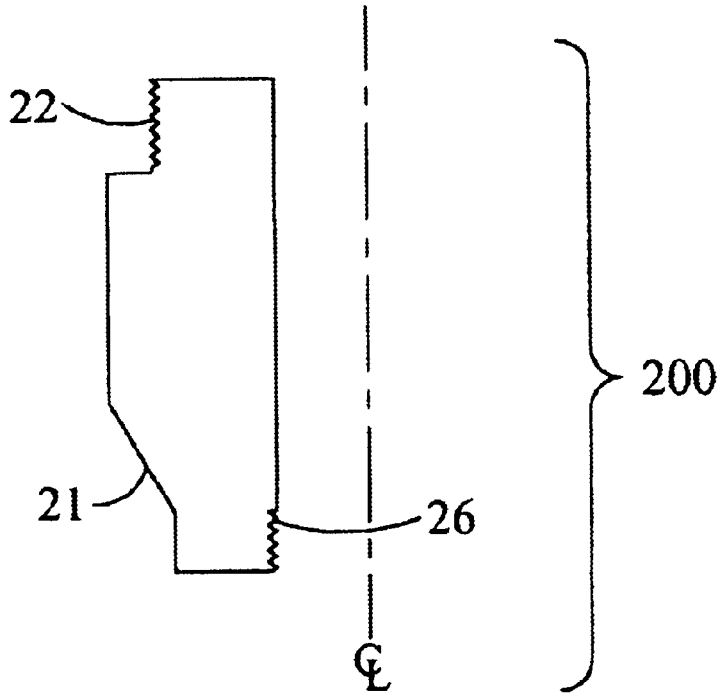
FIG. 8B is an enlarged cross-sectional view of the prototype head.

The preferred head, 20, is shown in detail in FIG. 8A and the prototype (alternate) head, 200 is shown in detail in FIG. 8B. The prototype head is manufactured (turned) from a single piece of suitable metal (stainless steel) and has the sloping valve face, 21, turned into the head as shown. The preferred embodiment is much simpler to manufacture and consists of three parts: an adapter, 23, a valve piece, 24, which is an off-the-shelf part manufactured by most pump manufacturers being their standard stinger face (see item 100—FIGS. 1 and 2), and the head piece, 28, which is readily turned and is designed to accept the adapter, 23, and valve piece, 24. The head piece, 28, has matching adapter threads, 25, to mate with the adapter, 23, and matching piston threads, 26, to mate with the piston. (Note it is possible to machine the valve piece from regular stock rather than purchase the item.)

FIG. 4 shows the instant device, 10, in its initial, or entry, assembled position. The device is assembled by placing the safety ring, 4, on the piston, 3, and pinning it in place with the safety ring shear pin, 5. The safety ring may incorporate an optional O-ring groove, 42, and O-ring, 43, to ensure that no fluid leaks by the ring; otherwise, tight machine tolerances may be used to minimize leakage. This O-ring is optional and may be left out of the assembly. It is preferred because the O-ring aids in piston assembly and movement of the safety ring within the barrel (stops galling). Further the O-ring may help prevent fluid by-pass if the safety ring shear pin is not tight within the corresponding aperture(s).

The assembly operation is continued by placing O-rings, 7, in the corresponding grooves on the piston and inserting the piston, 3, into the barrel, 1, from the bottom of the barrel. The entry shear pin, 6, is then inserted through the barrel entry pin aperture, 12, and into the piston entry pin aperture, 32, located in the piston ring, 31, at the midpoint between the top and the bottom of the ring. The head, 20, is then screwed onto the piston. The resulting "entry" assembly is shown in FIG. 5. The head valve, S, is open in the entry position, and the device is ready for installation on a reciprocating pump as described above (see FIG. 1). Tool grooves are provided on the barrel, the piston and the head so that the threads may be made up to proper torque limits without placing a strain on the shear pins.

The device is generally installed on a standard downhole reciprocating pump and inserted into the production tubing using standard industry techniques as shown in FIG. 1. As explained earlier, the device may be attached to a stinger and standing valve and dropped down the production tubing when it is employed in a tubing pump. When employed in a tubing pump a fishing neck may be attached above the standing valve (see FIG. 9) to facilitate wire line operations. In the "entry" position, the O-ring in the upper O-ring groove 35, inhibits fluid flow between the inside of the piston and the annulus. FIGS. 6 and 7 show the instant device in its two other respective operating positions namely closed and venting (and/or dumping), as will be explained.

The "entry-position" (as shown in FIG. 5) is not one hundred percent necessary and the step (or position) may be left out; however, practical experience dictates the need for an "entry position." It is known that insertion of a pump into a wellbore is fraught with difficulty—no wellbore is straight! Thus, while inserting the pump into the wellbore it may be necessary to reciprocate and rotate the entire string (pump and rods) when the pump hangs up in the wellbore. The entry position allows for movement of the string without shearing the safety shear pin (as will be explained) which is designed to shear at considerably less force than the entry pin(s). Thus, the force required to shear the entry pin (or pins) is set much higher than the force to shear the safety pin because the hydrostatic head will assist in providing the required shear force. (More than one entry shear pin may be required and the number of pins will be set by the required shear force and is easily determined by one skilled in the art.) The fixed entry position allows the operator to move the pump and device up and down (and rotate) thereby helping the pump enter the wellbore.

After operating the pump for a period of time it is known that sand will build up at the bottom of the tubing and the well operator must prepare to flush the sand away. The reciprocating pump sucker rod string or cable is lowered further into the wellbore. This operation causes additional weight to be applied to the device, in turn causing the piston to want to move down thereby shearing the entry shear pin(s), 6. The force applied to the shear pin(s) will equal the hydrostatic head plus the weight of the pump and associated rods. The shear pin(s) is (are) designed to shear at a predetermined pressure OVER the hydrostatic head pressure.

It should be noted that the force required to shear the entry pin is readily supplied by the total weight of the sucker rod string 105, pull rod, 104, and pump in a sucker rod driven pump (plus hydrostatic head). This is not the case in a cable driven pump and additional "weight" rods may have to be attached between the pull rod and the cable. Careful choice of the entry shear pin (or pins) and known hydrostatic head may remove the need for additional weight rods in a cable driven pump. Although only one pin is shown, additional pins and associated apertures may be employed to obtain the required overall shear force.

The device is now out of its "entry" position and is ready to operate. In this position, the head valve face, 21, and the barrel valve face, 11, come together to close the head valve, S. Thus fluid cannot flow from the within the piston to the annulus if the O-rings (in grooves, 35 and 37) are damaged. This is referred to as the "closed" position.

It now becomes necessary to clear the "safety." As explained earlier the "safety" is required to ensure that the valve will remained sealed (as to by-pass fluids) during the initial operation of the pump after it is run in the tubing. It is know that friction forces within the pump will cause the pump to ride upwards during the up stoke. The friction forces could be high enough to cause the valve to open up and allow fluid to by-pass into the annulus, thus preventing the pump from priming. I.e., filling the production tubing with fluid. Once the tubing is full, and if the valve is opened under controlled conditions—to be explained—the hydrostatic head pressure will hold the valve closed and overcome any expected friction forces.

It should be noted that it is possible to operate the valve without the "safety" but this is not recommended with barrel pumps. Operation without the "safety" could be a standard operating procedure when the device is used in a tubing pump simply because the device is NOT attached to the pump; however, it is not recommend. In a similar manner and in a tubing pump, it is possible to operate the valve without an "entry" position simply because the assembly will be dropped down a KNOWN open hole and reciprocation of the device will not be necessary to place it on the bottom and the assembly will fall through fluid on its way down, thus assuring some hydrostatic head above the device when it engages the hold-down. Again, this is not recommended. Finally, the device will have limited application with tubing pumps as its true use would be to dump produced fluid when pulling the string. A third embodiment of this device has been designed to only dump fluids and is the subject of another patent application.

To flush flower sand, the rod string or cable attached to the pump are slowly and deliberately pulled past its normal upside reciprocating position. Immediately prior to this action, make-up fluid must be supplied to the production at the surface or the entire fluid in the production tubing will U-tube (equate with the formation pressure) and allow air into the tubing. Drawing the rod string or cable upwards raises the piston, 3, within the barrel, 1, until the piston ring, 31, comes into contact with the safety ring, 4. The rod string or cable is then pulled further upwards thereby shearing the safety pin, 5, and continues upwards until the vent-dump or venting aperture(s) is (are) exposed as shown in FIG. 7. The safety ring, 4, sides along the piston and comes to rest against the piston ring, 31, and against the barrel lip, 14; thereby retaining the piston within the barrel.

This action exposes the vent-dump or venting aperture(s), 8, which in turn allow(s) fluid to flow from within the piston into the annulus thereby causing a swirling action that flushes the flower sand back up into the annulus and into the rat-hole thereby clearing the sand buildup around the cage (stinger) and seating nipple. This position is referred to as the "venting" position. The vent-dump or venting aperture (s) is (are) sized according to anticipated hydrostatic head and desired flow rate. A typical value would be between 3/32-inch and 3/16-inch and a plurality of such apertures or ports may be employed.

Note the difference between the instant device and the prior art. The instant device flushes the sand into the rat-hole. The prior art only stirs up the fluid within the tubing near the bottom hole discharge valve.

After a reasonable period of time elapses, the rod string or cable are restored to its operating position. This action causes the piston to move back into the barrel as shown in FIG. 6 to its closed position. It is anticipated that the O-rings (in grooves, 35 and 37) will still function; however, if they are damaged, the head valve, S, will stop all fluid flow.

The operation described is repeated as necessary during pumping operations to remove flower sand buildup.

Now assume that chemicals need to be "spotted" (placed in a required position) in the dead-space between the pump barrel and the tubing. Current practice introduces chemicals at the surface either by pouring the chemical down the annulus and pumping the fluid back up the tubing or by dumping chemical down the tubing and hoping that the chemical will migrate to the dead space. Chemicals can be spotted in the dead-space by a minor variation of the method for flushing flower sand as described above.

First assume that the "safety" has been released and that the venting aperture(s) may readily be opened by drawing up on the sucker rod string or cable. Now allow that the operator calculates the quantity of chemical that must be spotted (based on the barrel diameter, tubing diameter and barrel length, etc.) Also allow that the operator may calculate the quantity of fluid that is entrapped in the production tubing between the surface and the pump (again this is simple and is based on the tubing length and diameter).

The operator would then measure out the two quantities of fluid. The pumping operation would be stopped and the surface control valves closed so that the well is shut-in. A tube would be run between an ancillary surface valve (common in the industry for injecting fluids into the production tubing) and the measured chemical. The rod string or cable would be drawn upwards thereby opening the venting aperture(s). The surface valve is then opened drawing the chemical down the production tubing. When the chemical is fully ingested, the surface valve is closed. The tube is moved to the container containing a measured amount of produced fluid (equal to the volume required to spot the chemical as calculated) and the surface valve is again opened. The valve is closed after the measured quantity of produced fluid is drawn into the tubing. The rod string or cable is lowered back down thereby closing the instant device and normal pumping operations are resumed.

An alternate procedure may be followed. The operator would measure out the chemical and place that in a first container and then measure out the makeup fluid and place that in a second container. Conduit would be run from the two containers, through control valves and into the wellbore. The pumping operation would be stopped and the surface control valves closed so that the well is shut-in. The valve to the chemical is opened and the instant device is opened by drawing up on the rod string or cable. Just before the chemical container goes dry the valve is closed and the make up fluid valve is opened. Shortly before the make up container goes dry the rod string or cable is lowered thereby closing the instant device and the control valve (at the surface) is closed.

Other variations can readily be devised. The object of the procedure is place a measured amount of chemical in the area between the barrel and the tubing. It should be apparent that an overage of chemical will be required as well as a slight overage of make up fluid.

Now allow that the pump itself needs maintenance and the entire pump must be removed from the production tubing. The operation previously described to flush flower sand is repeated and the piston is moved to its venting position shown in FIG. 7 with the surface valve wide open. These actions expose the venting aperture(s), 8, that allows all the fluid in the production tubing to "dump" back into the annulus further washing sand and dumping the hydrostatic head above the pump, 102.

The only force that must now be used to remove the pump from within the production tubing is the force required to "pop" the valve cage free of the seating nipple. Thus the device acts to reduce the overall force that must be exerted thereby facilitating ready removal of the pump and reducing the chance that the entire production tubing must be removed.

The prototype embodiment of instant device also consists of three basic parts, the barrel, 1; the head, 200; and the piston, 3; plus several ancillary parts. The ancillary parts are the safety ring, 4; the safety shear pin, 5; the entry shear pin, 6; and six O-rings, 7, which are placed in associated O-ring grooves located on the piston. Three other critical functions (or devices) are formed in the device. These devices or functions are the vent port or aperture, 82, and the dump port or aperture, 9, which are formed in the piston, and the head valve, S, which exists between the head valve face, 21, and the barrel valve face, 11, when the two parts touch during certain operations of the device, as will be described.

Figure 11:
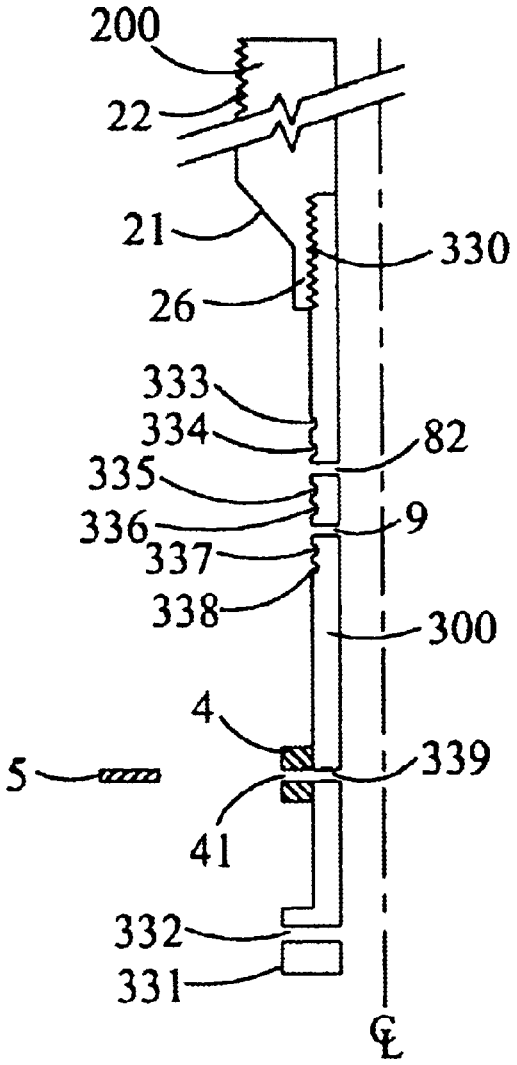
FIG. 11 is a cross-sectional view of the piston and header of the prototype embodiment of the instant device.

Referring to FIG. 11, the head, 200, is shown screwed into the piston, 3, the reason that these two parts screw together has already been explained. The head has a sloped face, 21, which forms a part of the auxiliary valve, S (see FIGS. 12 and 13). Located on the piston are a series of O-ring grooves, 333, 334, 335, 336, 337 and 338. These grooves accept O-rings, 7, as shown in FIGS. 12 through 15.

Figure 12:
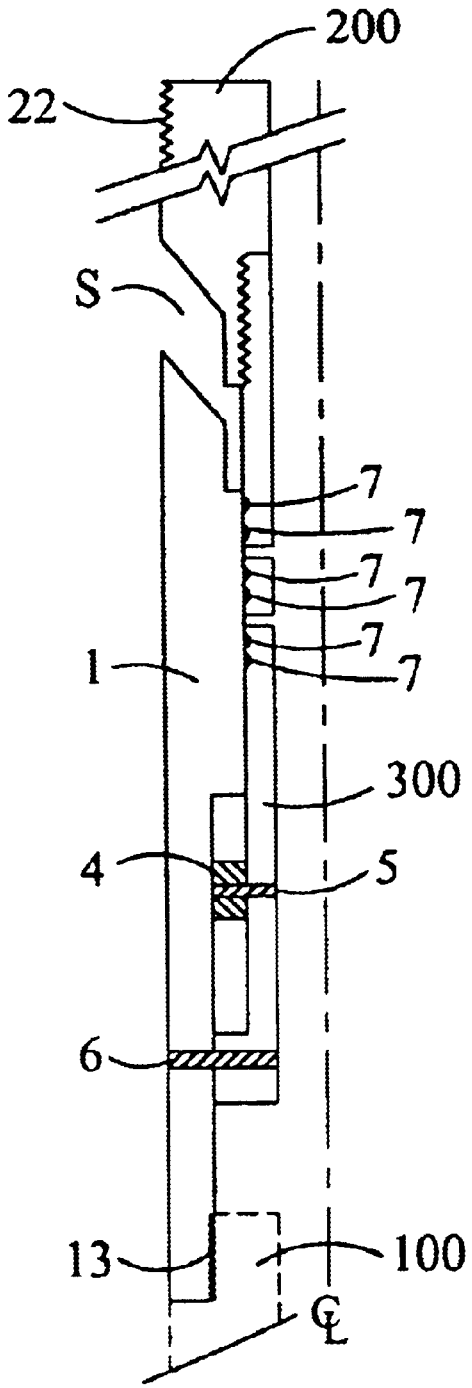
FIG. 12 is a cross-sectional view of the prototype embodiment of the instant device in its "entry" position.

As with the preferred embodiment, the piston fits (or slides) within a barrel, 1, shown in FIG. 12. The barrel has a sloped face, 11, which forms the other part of the head valve, S (see FIGS. 12 and 13). Located near the bottom of the barrel is the Barrel Entry Pin aperture, 12, which accepts the Entry Shear Pin, 6. Located at the bottom of the barrel are threads, 13, which accept a standard valve cage, 100 (see FIG. 1).

FIG. 12 shows the prototype embodiment of the instant device, 10, in its initial, or entry, assembled position. Like the preferred embodiment, the device is assembled by placing the safety ring, 4, on the piston, 3, and pinning it in place with the safety ring shear pin, 5. The assembly operation is continued by placing O-rings, 7, in the corresponding groves on the piston and inserting the piston, 3, into the barrel, 1, from the bottom of the barrel. The entry shear pin, 6, is then inserted through the barrel entry pin aperture, 12, and into the piston entry pin aperture, 332, located in the piston ring, 331. The head, 200, is then screwed onto the piston. The resulting "entry" assembly is shown in FIG. 12. The head valve, S, is open in the safety position and the device is ready for installation on a reciprocating pump as described above (see FIG. 1).

Figure 13:
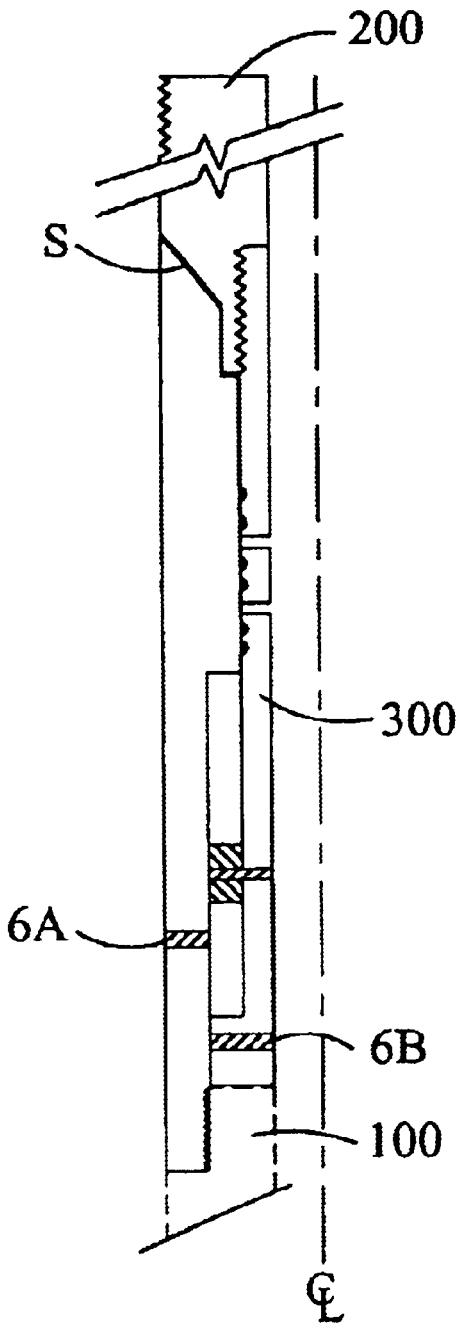
FIG. 13 is a cross-sectional view of the prototype embodiment of the instant device after being taken out of the entry position and showing the head valve in a closed position.
Figure 14:
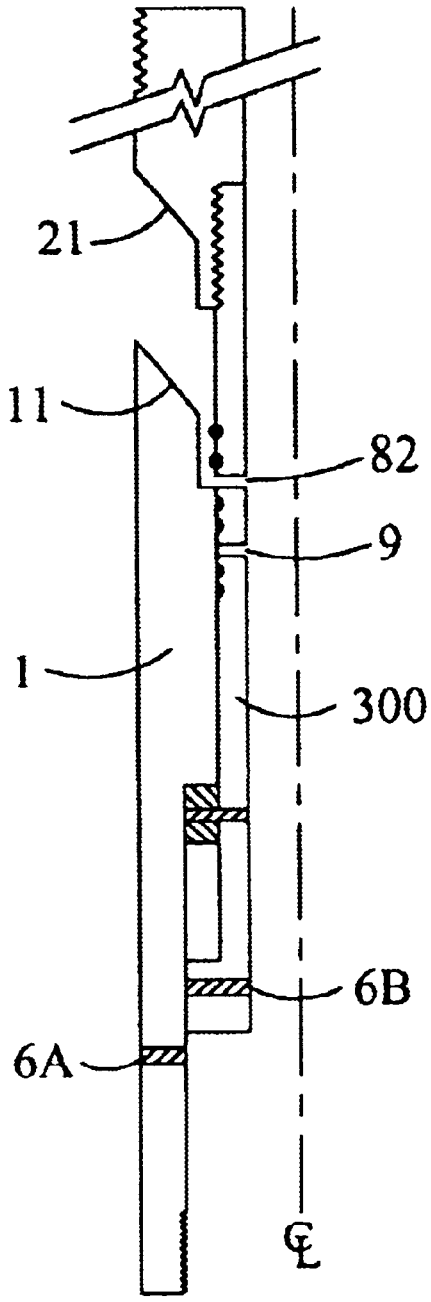
FIG. 14 is a cross-sectional view of the prototype embodiment of the instant device in its "vent" position.
Figure 15:
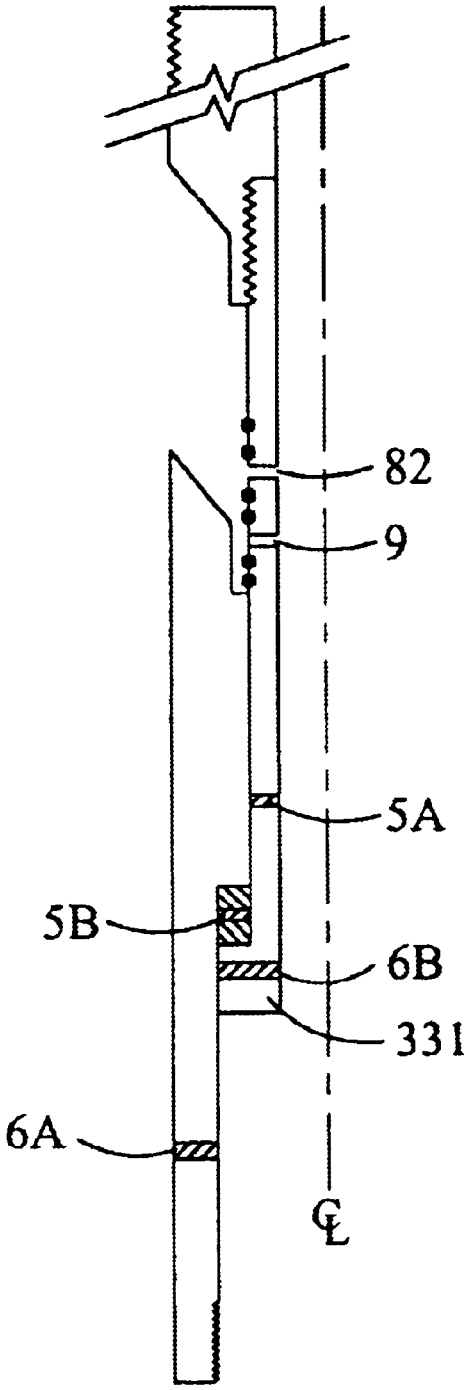
FIG. 15 is a cross-sectional view of the prototype embodiment of the instant device in its "dump" position and ready to come out of the well.

The device is installed on a standard downhole reciprocating pump and inserted into the production tubing using standard industry techniques as shown in FIG. 1. In the "entry" position, the O-rings in the upper set of O-ring grooves, 333 and 334, inhibit fluid flow between the inside of the piston and the annulus. FIGS. 13 through 15 show the instant device in its four other respective operating positions, closed, venting and dumping, as will be explained.

After operating the pump for a period of time it is known that sand will build up at the bottom of the tubing and the well operator must prepare to flush the sand away. The reciprocating pump sucker rod string or cable is lowered further into the wellbore. This operation causes additional weight to be applied to the device, in turn causing the piston to want to move down thereby shearing the entry shear pin, 6. The force applied to the shear pin will equal the hydrostatic head plus the weight of the pump and associated rods. The shear pin is designed to shear at a predetermined pressure OVER the hydrostatic head pressure.

The device is now out of its "safety" position and is ready to operate. In this position, the head valve face, 21, and the barrel valve face, 11, come together to close the head valve, S. Thus fluid cannot flow from the within the piston to the annulus if the upper set of O-rings, 333 and 334, are damaged. This is referred to as the "closed" position and is similar to the preferred embodiment.

To flush flower sand, the rod string or cable attached to the pump are slowly and deliberately pulled past its normal pull up reciprocating position. This action raises the piston, 3, within the barrel, 1, until the safety ring, 4, comes into contact with the reduced conduit within the barrel as shown in FIG. 14. This action exposes the vent aperture(s), 82, which in turn allows fluid to flow from within the piston into the annulus thereby causing a swirling action that flushes the flower sand back into the annulus and into the rat-hole clearing the buildup around the cage and seating nipple. This position is referred to as the "venting" position. The vent aperture is sized according to anticipated hydrostatic head and desired flow rate. A typical value would be 3/32-inch. It should be noted that the O-rings located in the mid-set of piston O-ring grooves (335 and 336) prevent fluid flow through the dump port, 9.

After a reasonable period of time elapses, the rod string or cable are restored to its operating position. This action causes the piston to move back into the barrel as shown in FIG. 13 to its closed position. It is anticipated that the upper O-rings (in grooves, 333 and 334) will still function; however, if they are damaged, the head valve, S, will stop all fluid flow.

The operation described is repeated as necessary during pumping operations to remove flower sand buildup. This operation may also be used to spot chemicals in the annulus as described for the preferred embodiment.

Now allow that the pump itself needs maintenance and the entire pump must be removed from the production tubing. The operation described above is repeated and the piston is moved to its venting position shown in FIG. 14. A period of time may be allowed to cause swirling and sand flushing or the rod string or cable may be further withdrawn thereby shearing the safety shear pin, 5, allowing the piston to move to its "dump" position as shown in FIG. 15. (The safety ring, 4, sides along the piston and comes to rest against the piston ring, 331, and against the barrel lip, 14; thereby retaining the piston within the barrel.) This action exposes the dump port or aperture, 9, that allows all the fluid in the production tubing to "dump" back into the annulus further washing sand and dumping the hydrostatic head above the pump, 102. The dump aperture is sized according to hydrostatic head and required dump time. A typical value would be 3/16-inch.

The only force that must now be used to remove the pump from within the production tubing is the force required to "pop" the valve cage free of the seating nipple. Thus the device acts to reduce the overall force that must be exerted thereby facilitating ready removal of the pump and reducing the chance that the entire production tubing must be removed.

As explained earlier the instant device may also be employed in tubing pumps. The bottom of the device is attached to the valve cage or stinger and the upper end is attached to the tubing pump standing valve. The standing valve in turn is attached to a retrieving collar (typically shown in FIG. 7) if wire line techniques are to be used. The entire assembly is then dropped down the production tubing and standard operating procedures are then followed. I.e., the well is pressure tested, the tubing pump is run down the tubing and the pump started.

Now allow that the entire tubing must be retrieved. The tubing pump would first be withdrawn. If the entry position shear pins are not employed, then standard wireline fishing techniques are employed and a fish is run down the tubing, which attaches (with luck) to the fishing neck. The line is pulled upwards shearing the safety pin(s) and placing the instant device in the fully open or dump position, The entire assembly is then removed from the tubing and the tubing is then retrieved.

Alternately, after the pump is withdrawn, standard sucker rods techniques (with or without the entry pins in place) may be used to pull the downhole vent-dump valve to the fully open or dump position following the descriptions already given.

It should be noted that the head valve, S, may be omitted if the valve will only be used once or twice while in the wellbore. This means that full reliance is being placed on the seals between the piston and the barrel. The preferred embodiment does not rely on O-ring seals: however, modern seal material is always being improved and a single seal that would hold up under wellbore conditions may be employed between the piston and barrel thus removing the need for the "backup" head valve. Such a seal and condition is envisioned by the inventor.

There has been described the preferred and best modes for the instant device. The choice of metals has not been specified and would be set by standard industry conditions and choices; however, the prototype device and current field models use 4140 stainless steel. The size of venting (vent-dump) aperture(s) in the preferred embodiment and the vent and dump port(s), or aperture(s), in the prototype embodiment is typical and a plurality of apertures may be employed. Standard techniques for sizing shear pins are employed and the entry shear pin may have to be increased to a plurality in order to obtain a desired shear force. For example 0.159-inch one-half hard brass may be used for all shear pins. (The same may be said about the safety shear pin.)

Item Listing

Offered as an aid to examination - to be included in the application at the discretion of the Examiner

| | | | |
|---|---|---|---|
| 1 | Barrel | 4 | Safety Ring |
| 11 | Barrel Auxiliary Valve Face | 41 | Safety Ring Safety Shear Pin Aperture |
| 12 | Barrel Entry Pin Aperture | | |

-continued

Item Listing

Offered as an aid to examination - to be included in the application at the discretion of the Examiner

| | | | |
|---|---|---|---|
| 13 | Barrel to Stinger or Valve Cage Threads | 42 | Optional Safety Ring O-ring Groove |
| 14 | Barrel Lip | 43 | Optional Safety Ring O-ring |
| 2 | Original Head (Prototype) | 400 | Tubing Pump Retrieving Collar |
| 20 | Preferred Head | 401 | Retrieving or Fishing Slot |
| 21 | Head Valve Face | 402 | Retrieving Collar to Head Threads |
| 22 | Head to Pump (Ball and Seal) Threads | 5 | Safety Shear Pin |
| 23 | Harbison-Fischer Adapter | 6 | Entry Shear Pin |
| 24 | Harbison-Fischer Valve Piece | 7 | Piston O-rings |
| 25 | Head to Adapter Threads | 8 | Vent-Dump or Venting Port (Aperture) (Preferred embodiment |
| 26 | Head to Piston Threads | 82 | Vent Port (Aperture) (Prototype embodiment) |
| 27 | Harbison-Fischer Adapter to Pump (Ball and Seal-Standing Valve) Threads | 9 | Dump Port or Aperture |
| 28 | Head Piece | 10 | The Instant Device in General |
| 3 | Piston | 100 | Valve Cage |
| 30 | Piston to Head Threads | 101 | Pump Ball and Seal Assembly |
| 31 | Piston ring | 102 | Pump |
| 32 | Piston Entry Pin Aperture | 103 | Optional Standing Head Valve |
| 33 | Piston Upper O-ring Groove | 104 | Pull Rod |
| 35 | Piston Lower O-ring Groove | 105 | Sucker Rod string |
| 39 | Piston Safety Shear Pin Aperture | 106 | |
| 300 | Prototype Piston | 107 | |
| 330 | Piston to Head Threads | 108 | |
| 331 | Cocking Ring | 109 | |
| 332 | Piston Cocking Pin Aperture | | |
| 333 | Piston First Upper O-ring Groove | | |
| 334 | Piston Second Upper O-ring Groove | | |
| 335 | Piston First Upper Dump O-ring Groove | | |
| 336 | Piston Second Upper Dump O-ring Groove | | |
| 337 | Piston First Lower Dump O-ring Groove | | |
| 338 | Piston Second Lower Dump O-ring Groove | | |
| 339 | Piston Safety Shear Pin Aperture | | |

I claim:

1. A reciprocating pump vent-dump valve utilized in hydrocarbon service for controlling the flow of produced fluid comprising:

a hollow piston having an upper end, a lower end, an inside and an outside;

a barrel having a top, a bottom, an interior and an exterior and adapted to slidingly receive said piston about said outside thereof;

a head having a topside and a bottom-side threadingly secured at said bottom-side thereof to said upper end of said piston;

a venting port situated approximately midway between said top and said bottom of said piston wherein said venting port provides communication between said inside and said outside of said piston; and, means for slidingly retaining said piston within said barrel;

wherein said piston is capable of limited upward and limited downward movement within said barrel such that when said piston is fully upward said venting port is in further communication with said exterior of said barrel placing the vent-dump valve in a venting position thereby allowing flow of produced fluid from said inside of said piston to said exterior of said barrel and such that when said piston is fully downward said venting port is not in communication with said exterior of said barrel placing the vent-dump valve in a closed position thereby inhibiting flow of produced fluid from said inside of said piston to said exterior of said barrel, and wherein said head is adapted to threadingly receive a downhole pump assembly or a standing valve assembly at said topside thereof.

2. The vent-dump valve of claim 1 wherein said piston has a circumference and wherein said means for slidingly retaining said piston within said barrel further comprises:

a piston ring formed about said circumference of said lower end of said piston extending radially away from said piston; and a barrel lip formed within said interior of said barrel approximately midway between said top and said bottom thereof;

wherein said piston ring comes to rest against said barrel lip when said piston is fully upward thereby inhibiting further upward movement thereof and wherein said bottom side of said cylindrical head comes to rest against said top of said barrel when said piston is fully downward thereby inhibiting further downward movement thereof.

3. The vent-dump valve of claim 2 wherein said piston ring has a midpoint and an outside and further comprising:

an entry shear pin;

a piston entry shear pin aperture radially formed at said midpoint of said piston ring adapted to receive said entry shear pin and extending from said inside of said piston to said outside of said piston ring; and, a barrel entry shear pin aperture radially formed near said bottom of said barrel also adapted to receive said entry shear pin and extending from said interior of said barrel to said exterior of said barrel;

such that when said entry shear pin is inserted into said barrel entry pin aperture said entry shear pin passes into said piston entry pin aperture thereby locking said piston in an entry position wherein a fixed distance is maintained between said lower end of said head and said top of said barrel thereby preventing further communication of said venting port with said exterior of said barrel thereby inhibiting flow of produced fluid from said inside of said piston to said exterior of said barrel.

4. The vent-dump valve of claim 1 wherein said piston has a circumference and wherein said means for slidingly retaining said piston within said barrel further comprises:

a piston ring formed about said circumference of said lower end of said piston extending radially away from said piston; and a barrel lip formed within said interior of said barrel approximately midway between said top and said bottom thereof;

a safety ring having an interior, an exterior, a top and a bottom adapted to be slidingly received by said piston;

a safety shear pin;

a safety ring safety shear pin aperture radially formed midway between said top and said bottom of said safety ring adapted to receive said safety shear pin and extending from said exterior of said safety ring to said interior of said safety ring; and, a piston safety shear pin aperture radially formed between said upper end and said lower end of said piston also adapted to receive said safety shear pin and extending from said outside of said piston to said inside of said piston;

such that when said safety shear pin is inserted into said safety ring safety shear pin aperture said safety shear pin passes into said piston safety shear pin aperture thereby locking said safety ring to said piston such that when said piston moves upward within said barrel said safety ring contacts said barrel lip thereby preventing full upward movement of said piston preventing further communication of said venting port with said exterior of said barrel thereby inhibiting flow of produced fluid from said inside of said piston to said exterior of said barrel; and such that when said safety shear pin is sheared said safety ring slides along said piston towards said piston ring thereby allowing further upward movement of said piston and allowing further communication between said venting port and said exterior of said barrel placing the vent-dump valve in said venting position thereby allowing flow of produced fluid from said inside of said piston to said exterior of said barrel; and such that when said piston is fully upward said safety ring comes to rest between said piston ring and said barrel lip thereby inhibiting further upward movement of said piston and wherein said bottom side of said cylindrical head comes to rest against said top of said barrel when said piston is fully downward thereby inhibiting further downward movement of said piston.

5. The vent-dump valve of claim 4 wherein said piston ring has a midpoint and an outside and further comprising:

an entry shear pin;

a piston entry shear pin aperture radially formed at said midpoint of said piston ring adapted to receive said entry shear pin and extending from said inside of said piston to said outside of said piston ring; and, a barrel entry shear pin aperture radially formed near said bottom of said barrel also adapted to receive said entry shear pin and extending from said interior of said barrel to said exterior of said barrel;

such that when said entry shear pin is inserted into said barrel entry pin aperture said entry shear pin passes into said piston entry pin aperture thereby locking said piston in an entry position wherein a fixed distance is maintained between said lower end of said head and said top of said barrel thereby preventing further communication of said venting port with said exterior of said barrel thereby inhibiting flow of produced fluid from said inside of said piston to said exterior of said barrel.

6. The vent-dump valve of claim 1 further comprising a head having a head valve face and wherein said top of said barrel is adapted to receive said head valve face such that when the vent-dump valve is fully downward said head valve face of said head valve seals against said top of said barrel thereby inhibiting fluid flow from said exterior of said barrel to said inside of said piston.

7. The vent-dump valve of claim 5 further comprising a head having a head valve face and wherein said top of said barrel is adapted to receive said head valve face such that when the vent-dump valve is fully downward said head valve face of said head valve seals against said top of said barrel thereby inhibiting fluid flow from said exterior of said barrel to said inside of said piston.

8. The vent-dump valve of claim 7 further comprising sealing means between said outside of said piston and said interior of said barrel.

9. The vent-dump valve of claim 1 further comprising sealing means between said outside of said piston and said interior of said barrel.

10. A reciprocating pump vent-dump valve utilized in hydrocarbon service for controlling the flow of produced fluid comprising:

a hollow piston having an upper end, a lower end, an inside and an outside;

a barrel having a top, a bottom, an interior and an exterior and adapted to slidingly receive said piston about said outside thereof;

a head having a bottom-side threadingly secured at said bottom-side thereof to said upper end of said piston;

a venting port situated approximately midway between said top and said bottom of said piston wherein said venting port provides communication between said inside and said outside of said piston;

a piston ring formed about said circumference of said lower end of said piston extending radially away from said piston having a midpoint and an outside;

a barrel lip formed within said interior of said barrel approximately midway between said top and said bottom thereof;

a safety ring having an interior, an exterior, a top and a bottom adapted to be slidingly received by said piston;

a safety shear pin;

a safety ring safety shear pin aperture radially formed midway between said top and said bottom of said safety ring adapted to receive said safety shear pin and extending from said exterior of said safety ring to said interior of said safety ring; and, a piston safety shear pin aperture radially formed between said upper end and said lower end of said piston also adapted to receive said safety shear pin and extending from said outside of said piston to said inside of said piston;

an entry shear pin;

a piston entry shear pin aperture radially formed at said midpoint of said piston ring adapted to receive said entry shear pin and extending from said inside of said piston to said outside of said piston ring; and, a barrel entry shear pin aperture radially formed near said bottom of said barrel also adapted to receive said entry shear pin and extending from said interior of said barrel to said exterior of said barrel;

such that when said entry shear pin is inserted into said barrel entry pin aperture said entry shear pin passes into said piston entry pin aperture thereby locking said piston in an entry position wherein a fixed distance is maintained between said lower end of said head and said top of said barrel thereby preventing further communication of said venting port with said exterior of said barrel thereby inhibiting flow of produced fluid from said inside of said piston to said exterior of said barrel; and such that when said safety shear pin is inserted into said safety ring safety shear pin aperture said safety shear pin passes into said piston safety shear pin aperture thereby locking said safety ring to said piston such that when said piston moves upward within said barrel said safety ring contacts said barrel lip thereby preventing full upward movement of said piston preventing further communication of said venting port with said exterior of said barrel thereby inhibiting flow of produced fluid from said inside of said piston to said exterior of said barrel; and such that when said safety shear pin is sheared said safety ring slides along said piston towards said piston ring thereby allowing further upward movement of said piston and allowing further communication between said venting port and said exterior of said barrel placing the vent-dump valve in said venting position thereby allowing flow of produced fluid from said inside of said piston to said exterior of said barrel; and such that when said piston is fully upward said safety ring comes to rest between said piston ring and said barrel lip thereby inhibiting further upward movement of said piston and wherein said bottom side of said cylindrical head comes to rest against said top of said barrel when said piston is fully downward thereby inhibiting further downward movement of said piston; and, wherein said piston is capable of limited upward and limited downward movement within said barrel such that when said piston is fully upward said venting port is in further communication with said exterior of said barrel placing the vent-dump valve in a venting position thereby allowing flow of produced fluid from said inside of said piston to said exterior of said barrel and such that when said piston is fully downward said venting port is not in communication with said exterior of said barrel placing the vent-dump valve in a closed position thereby inhibiting flow of produced fluid from said inside of said piston to said exterior of said barrel.

11. The vent-dump valve of claim 10 further comprising a head having a head valve face and wherein said top of said barrel is adapted to receive said head valve face such that when the vent-dump valve is fully downward said head valve face of said head valve seals against said top of said barrel thereby inhibiting fluid flow from said exterior of said barrel to said inside of said piston.

12. The vent-dump valve of claim 10 further comprising sealing means between said outside of said piston and said interior of said barrel.

13. A reciprocating pump vent-dump valve utilized in hydrocarbon service comprising:

a hollow piston having an upper end, a lower end, an inside and an outside;

a barrel having a top, a bottom, an interior and an exterior and adapted to slidingly receive said piston about said outside thereof;

a head having-a bottom-side threadingly secured at said bottom-side thereof to said upper end of said piston;

a vent port situated approximately midway between said top and said bottom of said piston wherein said vent port provides communication between said inside and said outside of said piston;

a dump port situated below said vent port wherein said dump port provides communication between said inside and said outside of said piston;

a piston ring formed about said circumference of said lower end of said piston extending radially away from said piston;

a barrel lip formed within said interior of said barrel approximately midway between said top and said bottom thereof;

a safety ring having an interior, an exterior, a top and a bottom adapted to be slidingly received by said piston;

a safety shear pin;

a safety ring safety shear pin aperture radially formed midway between said top and said bottom of said safety ring adapted to receive said safety shear pin and extending from said exterior of said safety ring to said interior of said safety ring; and, a piston safety shear pin aperture radially formed between said upper end and said lower end of said piston also adapted to receive said safety shear pin and extending from said outside of said piston to said inside of said piston;

such that when said safety shear pin is inserted into said safety ring safety shear pin aperture said safety shear pin passes into said piston safety shear pin aperture thereby locking said safety ring to said piston such that when said piston moves upward within said barrel said safety ring contacts said barrel lip thereby preventing full upward movement while allowing only partial upward movement; and, such that when said safety shear pin is sheared said safety ring slides along said piston towards said piston ring thereby allowing full upward movement of said piston; and, such that when said piston is frilly upward said safety ring comes to rest between said piston ring and said barrel lip thereby inhibiting further upward movement of said piston and wherein said bottom side of said cylindrical head comes to rest against said top of said barrel when said piston is fully downward thereby inhibiting further downward movement of said piston; and, wherein said piston is capable of limited upward and limited downward movement within said barrel such that when said piston is partially upward said vent port is in further communication with said exterior of said barrel placing the vent-dump valve in a venting position thereby allowing flow of produced fluid from said inside of said piston to said exterior of said barrel, such that when said piston is fully upward said dump port is in further communication with said exterior of said barrel placing the vent-dump valve in a dumping position thereby allowing flow of produced fluid from said inside of said piston to said exterior of said barrel and such that when said piston is fully downward said vent port and said dump are not in communication with said exterior of said barrel placing the vent-dump valve in a closed position thereby inhibiting flow of produced fluid from said inside of said piston to said exterior of said barrel.

14. The vent-dump valve of claim 13 wherein said piston ring has a midpoint and an outside and further comprising:

an entry shear pin;

a piston entry shear pin aperture radially formed at said midpoint of said piston ring adapted to receive said entry shear pin and extending from said inside of said piston to said outside of said piston ring; and, a barrel entry shear pin aperture radially formed near said bottom of said barrel also adapted to receive said entry shear pin and extending from said interior of said barrel to said exterior of said barrel;

such that when said entry shear pin is inserted into said barrel entry pin aperture said entry shear pin passes into said piston entry pin aperture thereby locking said piston in an entry position wherein a fixed distance is maintained between said lower end of said head and said top of said barrel thereby preventing further communication of said venting port with said exterior of said barrel thereby inhibiting flow of produced fluid from said inside of said piston to said exterior of said barrel.

15. The vent-dump valve of claim 14 further comprising a head having a head valve face and wherein said top of said barrel is adapted to receive said head valve face such that when the vent-dump valve is fully downward said head valve face of said head valve seals against said top of said barrel thereby inhibiting fluid flow from said exterior of said barrel to said inside of said piston.

* * * * *